US006216286B1

(12) United States Patent
Zankow

(10) Patent No.: US 6,216,286 B1
(45) **Date of Patent: *Apr. 17, 2001**

(54) COMBINED PLANTER AND WATERFALL FOR POOL OR THE LIKE

(76) Inventor: Stefan T. Zankow, 7001 Redlac Dr., Clifton, VA (US) 20124

( * ) Notice: Subject to any disclaimer, the term of this patent is extended or adjusted under 35 U.S.C. 154(b) by 0 days.

This patent is subject to a terminal disclaimer.

(21) Appl. No.: 09/376,486

(22) Filed: Aug. 18, 1999

(51) Int. Cl.[7] ..... E04H 4/00
(52) U.S. Cl. ..... 4/496; 239/17
(58) Field of Search ..... 4/496, 507; 239/16–20; D23/201

(56) References Cited

U.S. PATENT DOCUMENTS 0,327,673 * 10/1885 Gaillard ..... 239/17 X
3,930,334 * 1/1976 Johnston ..... 47/35
5,893,179 * 4/1999 Johnson ..... 4/507

FOREIGN PATENT DOCUMENTS

0602275 * 12/1925 (FR) ..... 239/20

* cited by examiner

*Primary Examiner*—Charles E. Phillips
(74) *Attorney, Agent, or Firm*—Rossi & Associates

(57) ABSTRACT

A combined receptacle and waterfall unit for a pool or the like, comprising a lower receptacle portion, an upper receptacle portion positioned above and within the lower receptacle portion to define a space therebetween, and a water dispensing unit positioned in the space between the upper and lower receptacle portions and being constructed to dispense water like a waterfall laterally outwardly adjacent to or near the substantially aligned outer peripheral edges of the upper and lower receptacle portions. The upper receptacle portion may be shaped to be used as a planter. A lighting device may be positioned on or near the water dispensing unit to illuminate the water being dispensed therefrom.

11 Claims, 4 Drawing Sheets

COMBINED PLANTER AND WATERFALL FOR POOL OR THE LIKE

BACKGROUND OF THE INVENTION

The present invention relates to a decorative accessory for a swimming pool or the like and, more particularly, to a combined planter and waterfall unit which can be installed adjacent to a pool or the like.

Currently, if it is desired to provide a waterfall for a swimming pool or the like, it is necessary in most cases that the waterfall unit be built into the pool or the deck surrounding it. Such installations are expensive and are difficult to service in the event of operational problems.

The combined planter and waterfall unit of the present invention is not subject to these disadvantages and possesses the following advantages:

1. It is a portable unit and can be easily installed in any desired position adjacent to a pool or the like;
2. It is simple in construction and thus easy and inexpensive to manufacture;
3. It is reliable in operation;
4. It can be easily serviced in the event of operational problems; and
5. It is attractive and streamlined in appearance and can be made in any suitable style or shape to complement a pool style and shape.

SUMMARY OF THE INVENTION

The combined planter and waterfall unit of the present invention generally comprises a lower receptacle portion of any suitable material having a rim, and an upper receptacle of any suitable material having a size and shape complementary to that of the lower receptacle portion so that it can be mounted on and inside of the lower receptacle portion. The upper receptacle portion has a rim that rests on the lower receptacle rim to position the upper receptacle portion within the lower receptacle portion with a predetermined space therebetween. Alternatively, the upper and lower receptacle portions may be formed of unitary construction.

A water dispensing unit of any suitable construction is mounted on the lower receptacle portion and is positioned between the upper and lower receptacle portions with the outer edge of its dispensing opening being substantially flush with or in close proximity to the adjacent outer edges of the rims of the upper and lower receptacle portions. Preferably the dispensing opening of the water dispensing unit is a wide opening or slit of narrow height defined by a sharp lower edge portion to produce a thin, wide and uniform flow or waterfall. In use, the combined planter and waterfall unit is positioned near the edge of a pool or the like so that the waterfall produced thereby flows into the pool.

The water dispensing unit is connected to a water source, such as the pool water, by a water line which extends therefrom through the space between the upper and lower receptacle portions, and then outwardly through an opening in the lower receptacle portion. The outer end of the water line is connected to a suitable water source such as the pump for circulating pool water or the like.

The upper receptacle portion can be used as a planter by filling it with soil or the like and planting a desired plant or plants therein. In this manner, the combined planter and waterfall unit serves a dual function in a very simple construction. The unit may be mounted on a pedestal or the like of any suitable construction.

DESCRIPTION OF THE PREFERRED EMBODIMENTS

Figure 3:
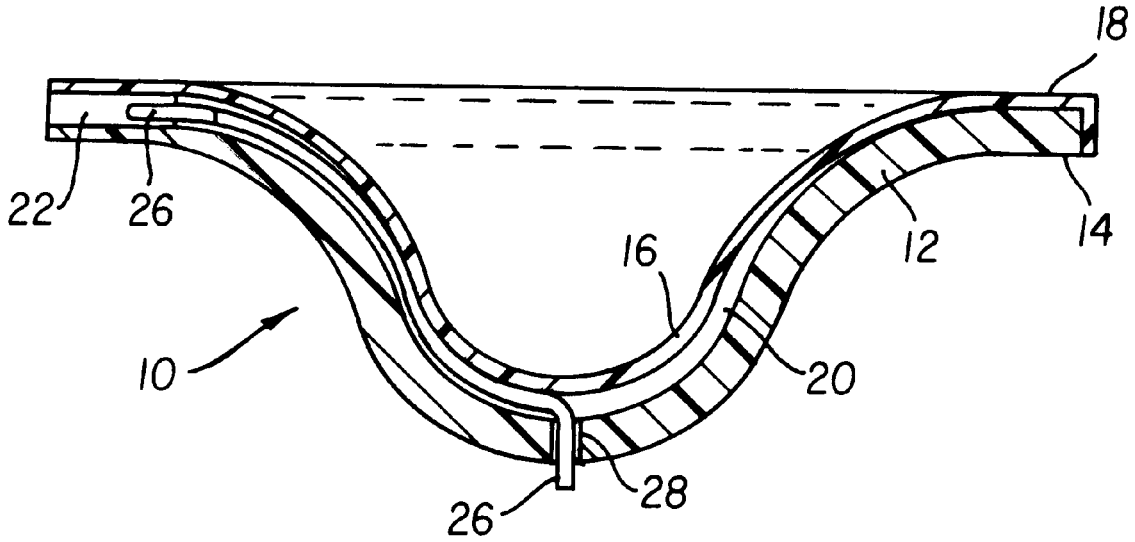
FIG. 3 is a sectional view taken substantially along line 3—3 in FIG. 2.
Figure 4:
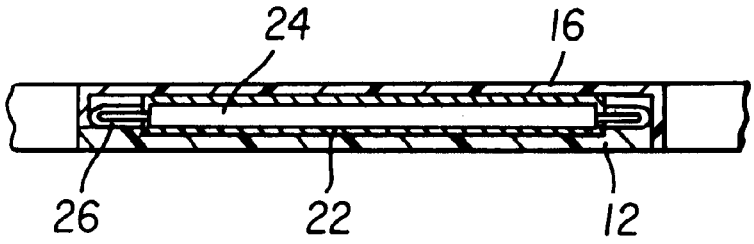
FIG. 4 is a sectional view taken substantially along line 4—4 in FIG. 2.

Referring to FIGS. 1–5, the combined planter and waterfall unit 10 generally comprises a lower receptacle portion 12 having a rim 14, and an upper receptacle portion 16 having a size and shape complementary to that of the lower receptacle portion so that it can be mounted on and inside of the lower receptacle portion 12. The upper receptacle portion 16 has a rim 18 that rests on the lower receptacle rim 14 to position the upper receptacle portion 16 within the lower receptacle portion with a predetermined space 20 therebetween, as shown in FIG. 3.

A water dispensing unit 22 of any suitable construction is mounted on the lower receptacle portion 12 and is positioned between the upper and lower receptacle portions with the outer edge of its dispensing opening 24 being substantially flush with or in close proximity to the adjacent outer edges of the rims 14, 18 of the lower and upper receptacle portions. Preferably, the dispensing opening 24 of the water dispensing unit 22 is in the form of a wide opening or slit of narrow height defined by a sharp lower edge portion to produce a thin, wide and uniform flow or waterfall. In use, the combined planter and waterfall unit 10 is positioned near the edge of a pool or the like so that the waterfall produced thereby flows into the pool.

The water dispensing unit 22 is connected in any suitable manner to a water source (not shown), such as the pool water, by a water line 26 which extends therefrom through the space 20 between the upper and lower receptacle portions 16, 12, and then outwardly through an opening 28 in the lower receptacle portion, as shown in FIG. 3. The outer end of the water line is connected in any suitable manner to a water source such as the pump for circulating pool water or the like.

Figure 1:
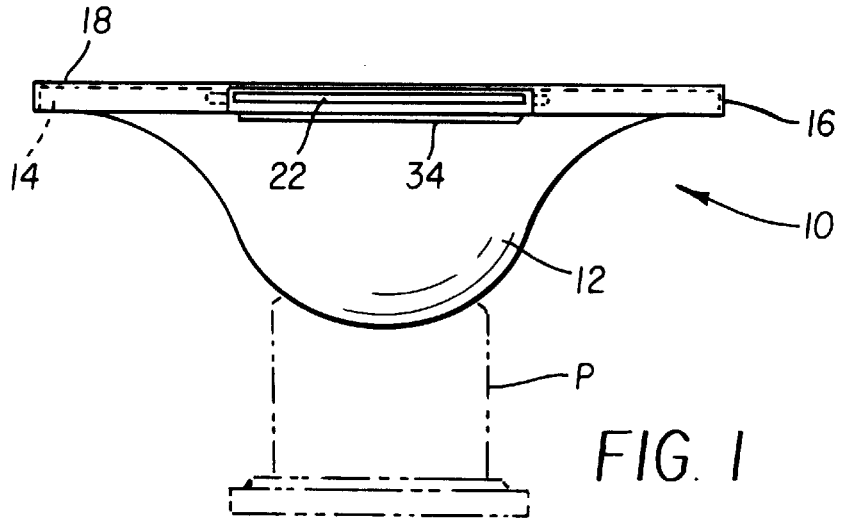
FIG. 1 is a side elevational view, with parts shown in broken lines, of one embodiment of the present invention.
Figure 2:
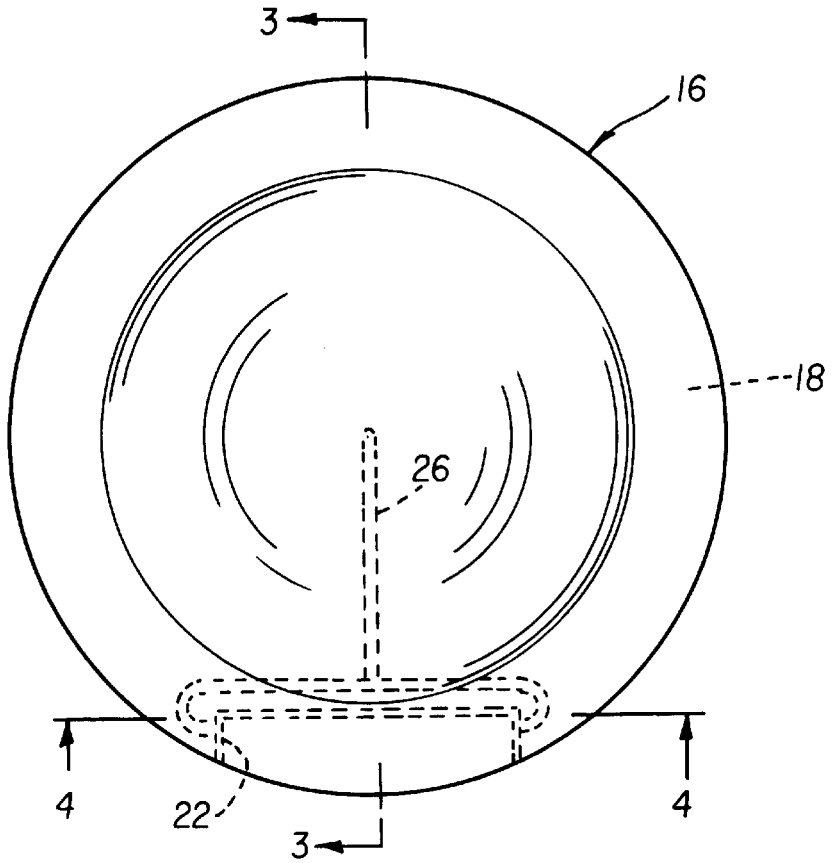
FIG. 2 is a top plan view of the present invention shown in FIG. 1, with parts shown in broken lines.

The upper and lower receptacle portions 16, 12 may be of any suitable shape and may be formed of any suitable material. The upper receptacle portion 16 can be used as a planter by filling it with soil or the like and planting a desired plant or plants (not shown) therein. In this manner the combined planter and waterfall unit 10 serves a dual function in a very simple construction. As shown in FIG. 1, the unit may be mounted on a pedestal P or the like of any suitable construction.

Preferably, the rim 18 of the upper receptacle portion is recessed on the lower surface thereof so as to fit over the rim 14 of the lower receptacle portion 12. The upper receptacle portion 16 may merely rest on the lower receptacle portion 12 so as to be removable therefrom, or may be secured in any suitable manner, such as by an adhesive, to the lower receptacle portion. Alternatively, the upper and lower receptacle portions may be formed of unitary construction.

Figure 5:
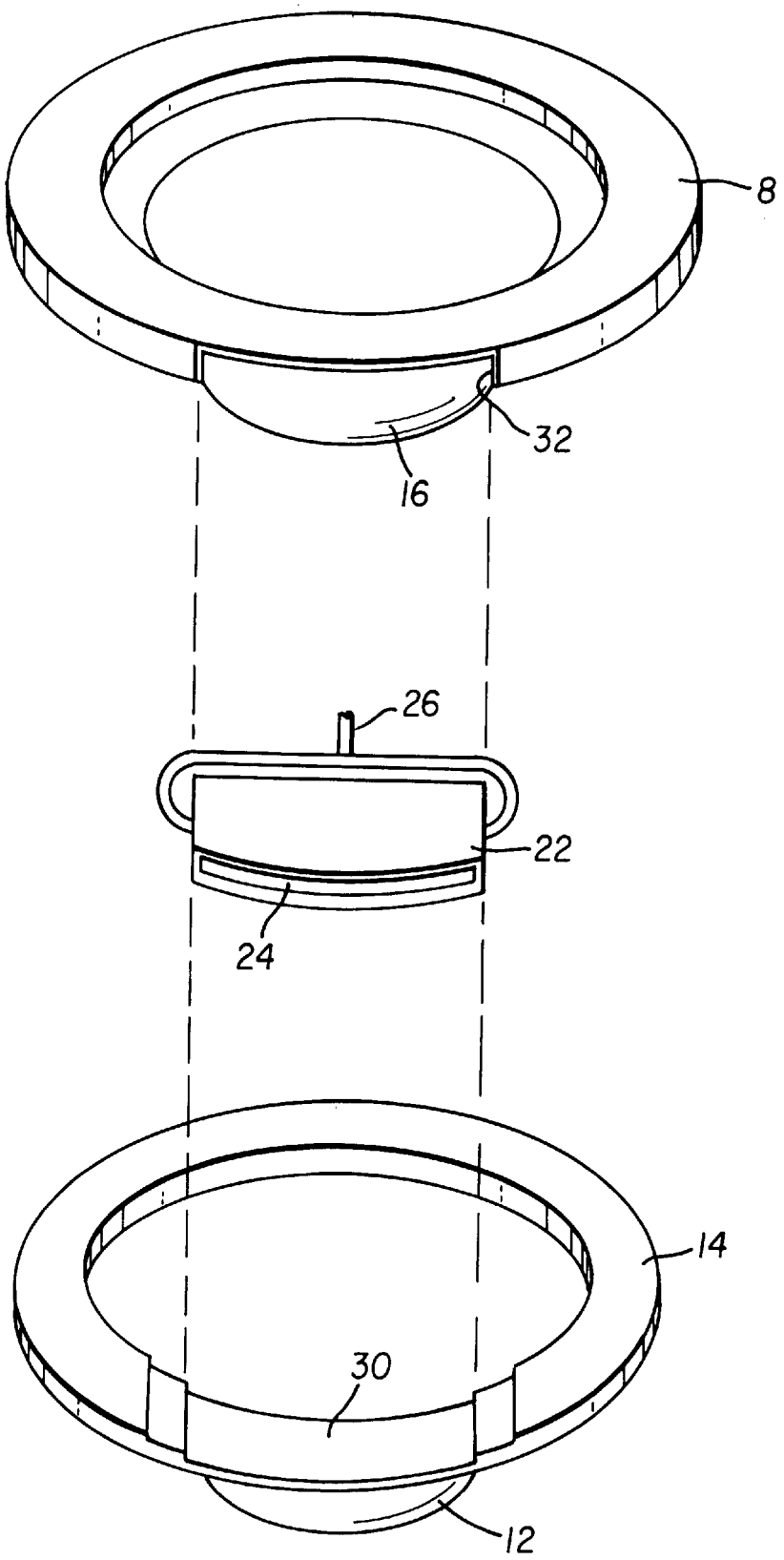
FIG. 5 is an exploded perspective view of the components of the present invention shown in FIG. 1.
Figure 6:
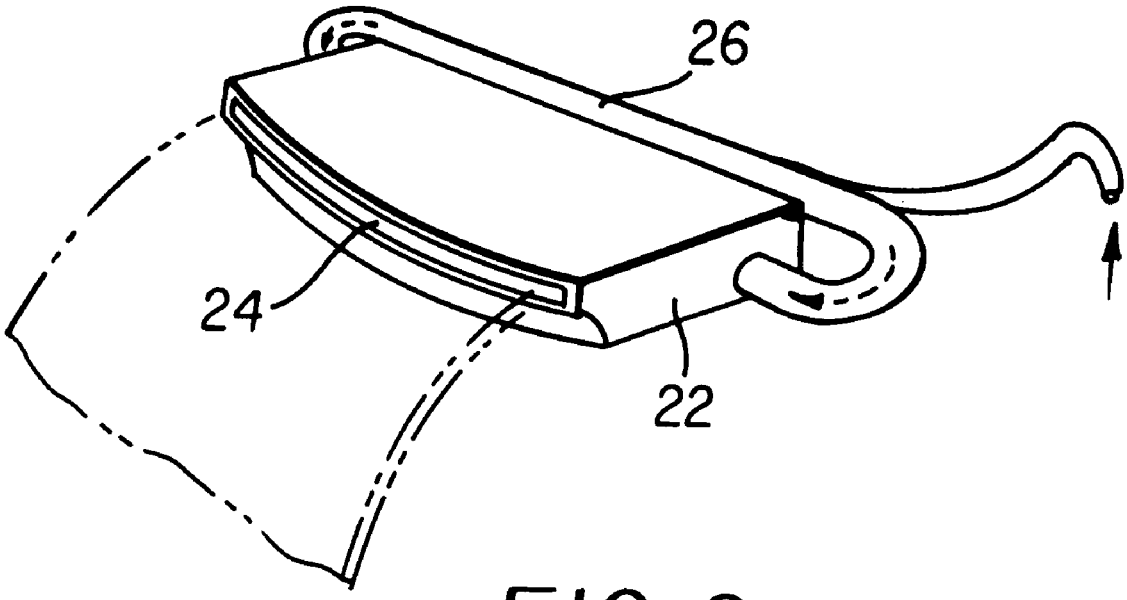
FIG. 6 is a perspective view of the water dispensing unit of the present invention.

As shown in FIG. 5, the rim 14 of the lower receptacle portion 12 may be provided with a recess 30 for receiving the water dispensing unit 22 therein, and the rim 18 of the upper receptacle portion 16 may be provided with an opening 32 to accommodate the water dispensing unit 22.

As an additional feature, lighting means such as a fiber optic stick 34 (FIG. 1) may be mounted on the lower portion of the rim 14 beneath the water dispensing unit 22 for the purpose of illuminating the waterfall flowing therefrom. The lighting means may be of any suitable form or construction.

What is claimed is:

1. A combined receptacle and waterfall unit for a pool or the like, comprising:

a lower receptacle portion;

an upper receptacle portion positioned above said lower receptacle portion to define a space therebetween; and water dispensing means positioned in said space between said upper and lower receptacle portions said dispensing means being constructed to dispense water substantially laterally outwardly adjacent to or near an outer peripheral edge of said upper and lower receptacle portions, wherein said upper and lower receptacle portions are complementary in size and shape such that said upper receptacle portion is received within said lower receptacle portion and has an outer rim that is connected to a complementary outer rim of said lower receptacle portion.

2. The unit of claim 1 wherein said upper receptacle portion is shaped to be used as a planter.

3. The unit of claim 1 wherein said water dispensing means comprises a wide dispensing opening of narrow height that is defined by a lower sharp edge portion to dispense water in a thin, substantially uniform film like a waterfall near the outer peripheral edges of said upper and lower receptacle portions.

4. The unit of claim 1 wherein said water dispensing means comprises a wide dispensing opening of narrow height that is defined by a lower sharp edge portion to dispense water in a thin, substantially uniform film like a waterfall near the outer peripheral edges of said upper and lower receptacle portions.

5. The unit of claim 4 wherein said lower receptacle portion has an opening therethrough, and said water dispensing means comprises a water supply line that extends therefrom through said space between said upper and lower receptacle portions and outwardly through said opening in said lower receptacle portion.

6. The unit of claim 4 wherein lighting means is mounted near said sharp edge portion of said water dispensing means to illuminate the film of water dispensed therefrom.

7. The unit of claim 6 wherein said lighting means comprises elongated fiber optic means positioned beneath and extending along said sharp edge portion of said water dispensing means.

8. The unit of claim 1 wherein said lower receptacle portion has a recess in a portion of said rim thereof, and said water dispensing unit is positioned in said recess.

9. A combined receptacle and waterfall unit for a pool or the like, comprising:

a lower receptacle portion;

an upper receptacle portion positioned above said lower receptacle portion to define a space therebetween; and water dispensing means positioned in said space between said upper and lower receptacle portions said dispensing means being constructed to dispense water substantially laterally outwardly adjacent to or near an outer peripheral edge of said upper and lower receptacle portions;

wherein said upper and lower receptacle portions are complementary in size and shape such that said upper receptacle portion is received within said lower receptacle portion and has an outer rim that rests on a complementary outer rim of said lower receptacle portion.

10. The unit of claim 9, wherein said water dispensing means comprises a wide dispensing opening of narrow height that is defined by a lower sharp edge portion to dispense water in a thin, substantially uniform film like a waterfall near the outer peripheral edges of said upper and lower receptacle portions.

11. The unit of claim 9 wherein, said lower receptacle portion has a recess in a portion of said rim thereof, and said water dispensing unit is positioned in said recess.

* * * * *